United States Patent [19]

Yamane et al.

[11] 4,177,401

[45] Dec. 4, 1979

[54] LOW PRESSURE METAL VAPOR DISCHARGE LAMP WITH TUBULAR MEMBER AND MAGNETIC MEANS

[75] Inventors: Mikiya Yamane; Teruichi Tomura, both of Kunitachi; Yoshio Watanabe, Tokyo, all of Japan

[73] Assignee: Hitachi, Ltd., Japan

[21] Appl. No.: 902,058

[22] Filed: May 2, 1978

[30] Foreign Application Priority Data

May 4, 1977 [JP] Japan ..... 52-50748

[51] Int. Cl.[2] ..... H01J 1/50; H01J 61/10; H01J 61/30; H01J 61/42

[52] U.S. Cl. ..... 313/485; 313/161; 313/204; 313/493

[58] Field of Search ..... 313/161, 493, 485, 204

[56] References Cited

U.S. PATENT DOCUMENTS

| | | | |
|---|---|---|---|
| 2,411,510 | 11/1946 | Abadie | 313/161 X |
| 3,079,521 | 2/1963 | Clark | 313/161 |
| 3,609,436 | 9/1971 | Campbell | 313/204 |

*Primary Examiner*—Palmer C. Demeo
*Attorney, Agent, or Firm*—Craig and Antonelli

[57] ABSTRACT

A low pressure metal vapor discharge lamp has a discharge envelope of a double tube structure filled with an inert gas and a small quantity of metal. The discharge envelope comprises a sealed outer glass bulb, and an inner glass tube disposed within the outer glass bulb substantially concentrically therewith and having one open end and the other closed end. The lamp further has a single cathode inside the inner glass tube, a plurality of anodes disposed exteriorly of the inner glass tube and interiorly of the outer glass bulb, and a permanent magnet disposed near the open end of the inner glass tube for applying a magnetic field of a fixed intensity near the open end.

24 Claims, 8 Drawing Figures

LOW PRESSURE METAL VAPOR DISCHARGE LAMP WITH TUBULAR MEMBER AND MAGNETIC MEANS

This invention relates to an improvement of a low pressure metal vapor discharge lamp and more particularly to a fluorescent lamp of a single base type which is reduced in size by utilizing a discharge envelope of a double tube structure.

A conventional low pressure metal vapor discharge lamp has, as typically exemplified in fluorescent lamps (low pressure mercury vapor discharge lamps) for general illumination purpose, an elongated glass tube with inner electrodes disposed at the opposite ends which is filled with an inert gas at a pressure of several Torrs and a small quantity of metal (for example, mercury). Take a linear or straight tube type fluorescent lamp having bases at the opposite ends, for example, the length of tube amounts to 120 cm for 40 W lamp, 63 cm for 30 W lamp, 58 cm for 20 W lamp and 44 cm for 15 W lamp. The fluorescent lamp having an elongated tube with two bases at the opposite ends suffers great inconvenience in certain operating conditions and moreover, is often considered disadvantageous for some purposes. Under the circumstances, it has recently been desired to develop a small-sized and highly illuminative fluorescent lamp having a tube length as short as possible.

An approach to this demand has been proposed in Japanese Patent Publication No. 35796/74. According thereto, an inner glass tube with one end opened is disposed inside an outer glass bulb to constitute a discharge envelope of a double tube structure, a cathode and an annular anode are disposed interiorly of and exteriorly of the inner glass tube, respectively, the discharge path between the cathode and the anode is folded back at the open end of the inner glass tube to establish an elongated discharge path, and a single base is provided, whereby the entire size of the lamp can be reduced. This approach is also expected to provide a highly illuminative lamp because it is possible to increase the surface area of the glass tube surrounding the discharge space with an increase of the area at which a phosphor substance is coated so that ultraviolet rays created by discharging can be converted into visible rays effectively.

The aforementioned discharge lamp of the double tube structure, however, has difficulties with creation of a uniform discharge plasma throughout the discharge space defined by the outer bulb and the inner tube (namely, the discharge space outside the inner tube). More particularly, the discharge plasma in the exterior of the inner tube will be localized at a part of the discharge space which extends along a path through which discharging current is facilitated to flow. In addition, it sometimes happens that the localized plasma will run zigzag or "snake" within a restricted region. Needless to say, this lamp will luminesce with high brightness through the lamp surface on the side at which the plasma is concentrated but with a considerably lower brightness through the lamp surface on the side at which the plasma does not prevail. Naturally, it follows that luminous brightness over the whole lamp becomes quite irregular, thereby impairing the availability of such discharge lamps as light sources for illumination purposes. Also, irregular snaking displacement of the plasma is responsible for variation in the quantity of light emanated from the lamp and consequent flicker.

A countermeasure for preventing the localization of discharge plasma in the discharge lamp of double tube structure type has been proposed (see U.S. Pat. No. 3,609,436 and Journal of the Illuminating Engineering Society, Vol. 2, No. 2, October 1972, pages 3 to 7) wherein a plurality of anodes are provided in the exterior of the inner tube and these anodes are successively switched over to shift the discharge path forcibly. Because of the forcible shifting of the discharge path around the inner tube, this countermeasure requires a sophisticated, expensive transistor switching circuit for switching over the application of voltage to the anodes, being uneconomical and impractical.

It is accordingly an object of this invention to provide an improved low pressure metal vapor discharge lamp of the double tube structure type capable of preventing localization and irregular displacement of the discharge plasma to thereby produce an output of light which is uniform and stable throughout the whole lamp.

According to one aspect of the invention, there is provided a low pressure metal vapor discharge lamp comprising: a discharge envelope including an outer bulb of light-transmissive material and an inner tube disposed within said outer bulb, said inner tube having one open end and the other closed end; an inert gas and metal filled in said envelope; a cathode disposed interiorly of said inner tube; an anode disposed exteriorly of said inner tube and interiorly of said outer bulb; and magnetic field applying means disposed near the open end of said inner tube for applying a magnetic field near the open end.

According to another aspect of the invention, there is provided a low pressure metal vapor discharge lamp comprising: a discharge envelope including an outer bulb of light-transmissive material and an inner tube disposed within said outer bulb, said inner tube having one open end and the other closed end; an inert gas and metal filled in said envelope; a cathode disposed interiorly of said inner tube; a plurality of anodes disposed exteriorly of said inner tube and interiorly of said outer bulb; and magnetic field applying means disposed near the open end of said inner tube for applying a magnetic field near the open end.

According to a further aspect of the invention, there is provided a low pressure mercury vapor discharge lamp comprising: a discharge envelope including an outer glass bulb and an inner glass tube disposed concentrically therewith, said inner glass tube having one open end and the other closed end; an inert gas and a small quantity of mercury filled in said envelope; a cathode disposed interiorly of said inner glass tube and near the closed end of said inner glass tube; a plurality of anodes disposed, near the closed end of said inner glass tube, exteriorly of said inner glass tube and interiorly of said outer glass bulb; and a permanent magnet disposed near the open end of said inner glass tube for applying a magnetic field of a fixed intensity near the open end.

BRIEF DESCRIPTION OF THE DRAWING

Other objects, features, and operation and effect of the invention will become apparent from the following detailed description taken in conjunction with the accompanying drawings in which.

DETAILED DESCRIPTION

Prior to describing preferred embodiments of the invention, for better understanding of the invention, essential construction and operation of a prior art low pressure mercury vapor discharge lamp of a double tube structure type will first be described briefly with reference to FIG. 1.

Figure 1:
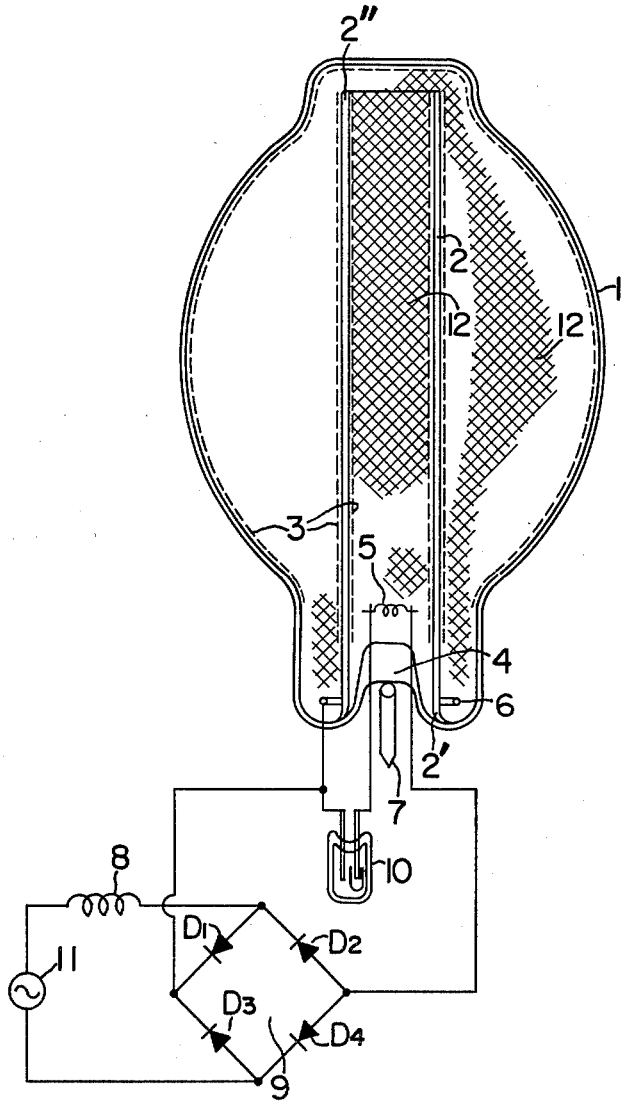
FIG.1 PRIOR ART
FIG. 1 is a schematic diagram, partly in longitudinal section, of a prior art low pressure metal vapor discharge lamp of a double tube structure type.

A low pressure mercury vapor discharge lamp as diagramatically shown in FIG. 1 comprises an outer glass bulb 1 having a circular crosssection for constituting a discharge envelope, and a cylindrical inner glass tube 2 disposed inside the outer glass bulb. The inner glass tube 2 is arranged concentrically with the outer glass bulb 1, thus forming a discharge envelope of a double tube structure type. The inner glass tube 2 has a lower end 2' bonded to a stem 4 for its closure and an open upper end 2". The open end 2" is spaced from the top inner surface of the outer glass bulb 1, leaving a gap for discharge path. The inner and outer surfaces of the inner glass tube 2 and the inner surface of the outer glass bulb 1 are provided with a coating of phosphor films 3. By a stem 4 interiorly of the inner glass tube 2 and at the lower end of the same is supported a cathode 5 comprising a coiled filament coated with a electron emissive substance whereas an annular anode 6 is supported by a flare of the stem 4 exteriorly of the inner glass tube 2 and at the lower end thereof.

The interior of the discharge envelope 1 is evacuated through an evacuation pipe 7 and filled with an inert gas at a pressure of several Torrs and a small quantity of mercury. Thereafter, the evacuation pipe 7 is sealed at its tip. By mounting a single base (not shown) to the lower end of the discharge lamp of double tube structure type thus constructed, a discharge lamp with a single base can be completed.

When connected to an AC power supply 11 through a starter circuit including a stabilizer 8, a rectifier 9 (full-wave rectifier) comprised of a bridge connection of diodes $D_1$, $D_2$, $D_3$ and $D_4$, and a glow lamp 10, this discharge lamp can be turned on. The starter circuit may be separated and located remote from the discharge lamp or, if desired, it may be incorporated into the interior of the discharge lamp base.

With the prior art discharge lamp shown in FIG. 1, however, a discharge plasma exterior of the inner glass tube 2 is concentrated and localized at a part of the space surrounding the inner glass tube, as shown by the hatched illustration in FIG. 1. The localization of the discharge plasma obviously prevents production of an output of light which is uniform throughout the whole lamp.

The invention intends to eliminate drawbacks of the prior art double tube structure type discharge lamp by applying a magnetic field of a fixed intensity near the open end of the inner glass tube such that the discharge plasma is caused to rotate about the inner glass tube by the action of the magnetic field, whereby the plasma discharge can be distributed uniformly over the entire space interior of the discharge envelope and a uniform output of light can be produced from the whole lamp.

Figure 2:
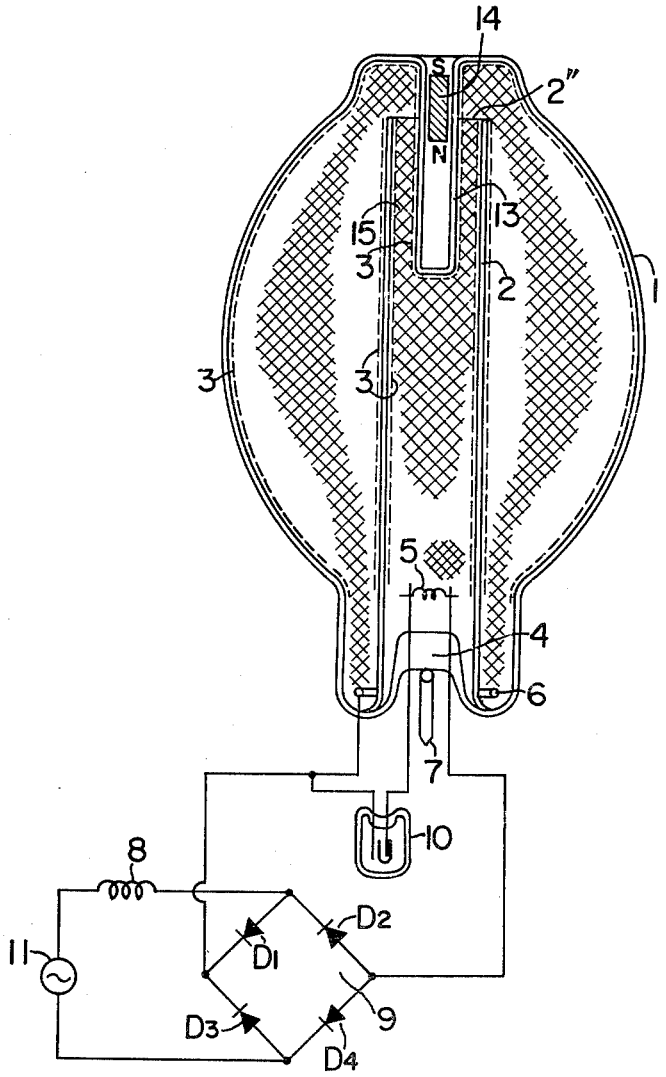
FIG. 2 is a similar diagram to FIG. 1 of one embodiment of a low pressure metal vapor discharge lamp according to the invention.

Referring now to FIG. 2, a first embodiment of the invention comprises an outer glass bulb 1 which, at its top, emerges into a tubular recess 13. This tubular recess 13 is concentric with the inner glass tube 2 and the outer glass bulb 1. Between the tubular recess 13 and the inner glass tube 2 is formed an annular gap 15 (narrowed space for discharging). A columnar permanent magnet 14 is inserted in the tubular recess 13. The outer surface of the tubular recess 13 that is exposed to the interior space of the discharge envelope is provided with a coating 3 of phosphor film.

Except for the above construction, the discharge lamp of FIG. 2 has the same construction as FIG. 1. Thus, it will be seen that the present embodiment is featured by the provision of the permanent magnet 14 for generating near the open end 2" of the inner glass tube 2 a magnetic field having a fixed intensity which intersects discharging current. The magnetic field created by the permanent magnet 14 acts on discharge plasma near the open end 2" of the inner glass tube 2, causing the discharge plasma to rotate about the axis of the discharge lamp.

The columnar permanent magnet 14 is magnetized in the axial direction of discharge lamp and the behavior of a discharge plasma intensively sensitive to the magnetic field due to the permanent magnet 14, that is, of a discharge plasma persent in the gap 15 between the inner glass tube 2 and the tubular recess 13 is managed by the following electromagnetic hydrodynamics equation:

$$\frac{\delta J}{\delta t} = \frac{ne^2}{m}\left(E + \langle Ve\rangle \times B - \frac{J}{\sigma_{eff}}\right)$$

where J represents current density, n density of electrons, e charge of electron, m mass of electron, E electric field intensity, $\langle Ve\rangle$ mobility of electron, B magnetic field intensity, and $\sigma_{eff}$ effective electric conductivity. Electron has a mobility $\langle Ve\rangle$ of about $5\times10^5$ cm/sec in an argon gas atmosphere when E/P (electric field intensity/pressure) is 1 V/cm.Torr. With a magnetic field intensity of 500 gausses, an "apparent electric field" having an electric field intensity of 2.5 V/cm exists which is perpendicular to both the direction of electron movement and the direction of magnetic field. This value is not so small as comparable to values of intensity of electric fields actually existing in various plasmas. In this connection, it is noted that a linear tube type fluorescent lamp is operated under an intensity of electric field of 0.7 to 0.8 V/cm.

Figure 3:
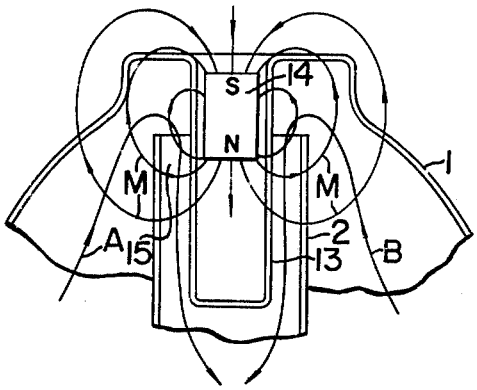
FIG. 3 is a diagramatic representation useful to explain operation and effect of the application of a magnetic field according to the invention.

In the low pressure mercury vapor discharge lamp according to the invention, the plasma can be driven magnetically with great effect. FIG. 3 exaggerates an illustration to explain this effect.

The columnar permanent magnet 14 inserted in the tubular recess 13 with its N-pole down faced will produce a magnetic field as shown at arrowed solid curves. If discharging current is localized to flow along a path as shown at solid curve A in FIG. 3, the discharging current intersects the magnetic flux substantially at right angles in the discharging narrowed space 15 between the inner glass tube 2 and the recess 13 so that a force acts on the discharge plasma to cause it to move perpendicularly to the paper sheet and in the front to rear direction with respect to the same. If the discharging current is localized to flow along a path as shown at solid curve B in FIG. 3, the discharge plasma within the discharging narrowed space 15 is applied with a force directed in the rear to front direction with respect to the paper sheet. In consequence, the discharge plasma which would be concentrated and localized at a part of the interior space of discharge envelope without the application of those forces is caused to rotate about the axis of the discharge lamp. Although the discharge plasma present in a gap between the outer glass bulb 1 and the inner glass tube 2 is applied with a force which causes this discharge plasma to rotate inversely, the intensity of magnetic field is relatively small in this gap and hence, a resultant rotation of the discharge plasma is subject to the rotational direction at the discharging narrowed space. In other words, the behavior of plasma within the outer glass bulb 1 is mainly managed by the behavior of plasma within the discharging narrowed space 15.

The discharge lamp as exemplified in the embodiment of FIG. 2 has specified dimensions including a tube length of 16 cm and a maximum diameter of 9 cm of the outer bulb 1; an outer diameter of 3.2 cm, an inner diameter of 3.0 cm and a tube length of 13 cm of the inner glass tube 2; an outer diameter of 1.5 cm, an inner diameter of 1.3 cm and a length of 6 cm of the tubular recess 13; and a diameter of 1.2 cm and a length of 1.5 cm of the columnar permanent magnet made of Alnico which is inserted in the recess. This specified discharge lamp is filled with an argon gas at a pressure of 2.7 Torrs and a small quantity of mercury and turned on with a discharging current of 0.6 A. The intensity of magnetic field at the discharging narrowed space and the revolution per second of the discharge plasma rotating about the axis of discharge lamp were measured for this lamp.

More particularly, according to an experiment in which the magnetic field intensity at the discharging narrowed space 15 was varied by slightly changing the axial position of the permanent magnet 14, the discharge plasma started rotating at an intensity of magnetic field of about 20 gausses and rotated at a speed of about 10 revolutions/sec. As the magnetic field intensity increases, the revolution of the discharge plasma increases, reaching to 90 revolutions/sec at 100 gausses in which the discharge lamp is visually observed as if the whole envelope were filled with a uniform plasma.

As will be seen from the above description, according to the invention, the permanent magnet inserted in the recess provided for the top of the outer bulb applies to the discharging narrowed space the magnetic field which causes the plasma to rotate, thereby producing a visually uniform plasma throughout the whole lamp. This ensures the provision of a low pressure metal vapor discharge lamp in which a coating of phosphor on the inner surface of the outer bulb and the inner and outer surfaces of the inner glass tube luminesces through the whole surface of the lamp with a substantially uniform luminous brightness.

Figure 4:
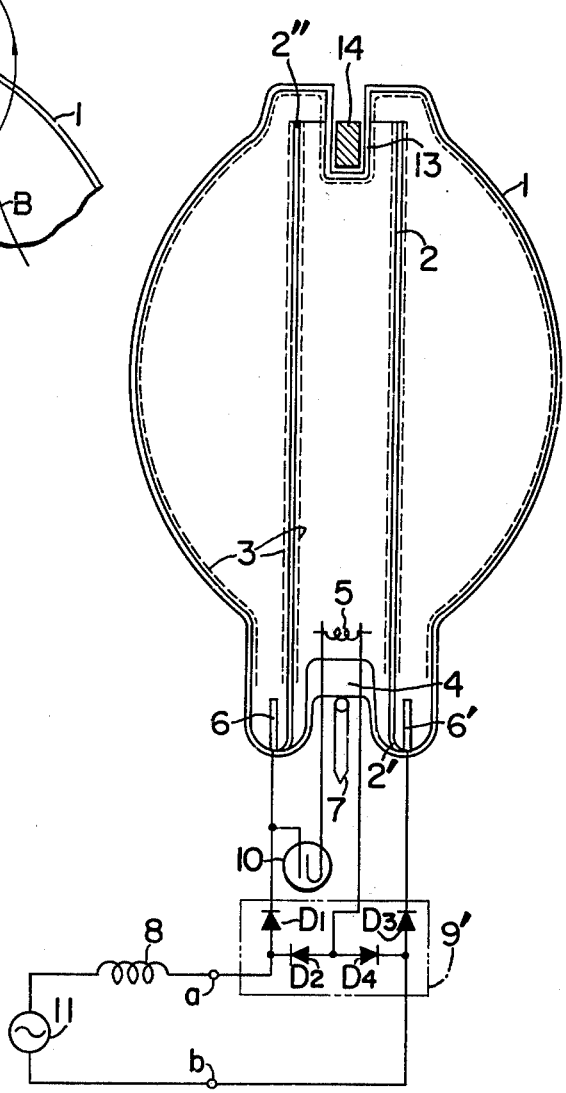
FIG. 4 is a schematic diagram, partly in longitudinal section, of another embodiment of low pressure metal vapor discharge lamp according to the invention.

In place of the recess 13 of the outer bulb jutting deeply into the inner glass tube 2 as in the embodiment of FIG. 2, a relatively shallow recess as shown in FIG. 4 may be provided to form a short discharging narrowed space adjacent the inner glass tube 2, attaining a similar rotation of the discharge plasma. While, in the preferred embodiment of FIG. 2, the permanent magnet was preferably used as magnetic field applying means and inserted in the tubular recess provided for the top of the discharge envelope, a DC electromagnet may substitute for the permanent magnet and the magnet for rotating the plasma may be located interiorly of the discharge envelope or exteriorly of the same near the top portion without forming the aforementioned tubular recess. In brevity, the application of the magnetic field of fixed intensity near the open end of the inner glass tube may be realized in various ways, thus causing the discharge plasma to rotate about the lamp axis.

The location of the permanent magnet within the tubular recess provided for the top of discharge envelope as in the embodiment of FIG. 2 is advantageous in the following points: in spite of the location of the permanent magnet exterior of the discharge envelope, a large intensity of the magnetic field can be applied near the open end of the inner glass tube; the insertion of the permanent magnet into the tubular recess is possible after heating, evacuating and gas-filling processes have been completed, so that easy manufacture of the lamp can be ensured which is followed by easy adjustment of location of the magnet; and the location of the permanent magnet exterior of the discharge envelope permits, as the permanent magnet, the use of a low Curie temperature ferrite magnet which is inexpensive.

Turning to FIG. 4, a second embodiment of the invention will be detailed. This embodiment comprises a permanent magnet 14 inserted in a tubular recess provided for the top of the outer glass bulb 1 constituting a discharge envelope, and a plurality of (two in the figure) anodes 6 and 6′ disposed around the closed end 2′ (end portion on the side of stem) of the inner glass tube 2. The two anodes 6 and 6′ are spaced apart with interposition of the inner glass tube 2 therebetween and also electrically isolated from each other. That is to say, the embodiment of FIG. 4 is featured by dividing the anode into a plurality of anode electrodes.

With a single annular anode as in the aforementioned embodiment of FIG. 2, electron beam current coming into the anode concentrates to an optional point on the anode and hence the discharge plasma near the anode tends to localize at a part of the interior space of the discharge envelope. Moreover, the point to which the electron beam current is concentrated (anode point) tends to move irregularly on the surface of the annular anode. As a result, an output of light flickers at the base portion (near the anode) of the lamp. The embodiment of FIG. 4 solves this problem.

More particularly, a low pressure mercury vapor discharge lamp as shown in FIG. 4 comprises a double tube structure type envelope having concentric outer glass bulb 1 and inner glass tube 2, a permanent magnet 14 disposed near the top of the envelope for generating a magnetic field which causes the discharge plasma to rotate about the axis of the lamp, a plurality of anode electrodes 6 and 6′ arranged near the base portion (end on the side of stem) of the discharge lamp such that electron beam currents coming into the individual anode electrodes are distributed to thereby distribute the discharge plasma uniformly throughout the interior space of the discharge envelope.

The embodiment of FIG. 4 has specified dimensions including a tube length of 17 cm and a maximum diameter of 9 cm of the outer glass bulb 1; an outer diameter of 3.2 cm, an inner diameter of 3 cm and a tube length of 15 cm of the inner glass tube 2; an inner diameter of 1.4 cm and a depth of 2.5 cm of the tubular recess 13 provided for the top of the outer glass bulb 1; and a diameter of 1.3 cm and a length of 1 cm of the columnar permanent magnet 14 made of Alnico which is inserted in the tubular recess 13. The Alnico magnet is magnetized axially and has a surface magnetic flux density of about 500 gausses. Two rod shaped anode electrodes 6 and 6' are arranged about the axis of the discharge lamp at the base portion (end on the side of stem) of the lamp with an angular spacing of 180°. A rectifier circuit 9' including diodes $D_1$, $D_2$, $D_3$ and $D_4$ is connected to the lamp in such a manner that electron beam current flows into the anode electrode 6 when a power supply terminal a bears the positive phase and electron beam current flows into the anode electrode 6' when a power supply terminal b bears the positive phase.

The discharge envelope is filled with an argon gas at a pressure of 2.7 Torrs and a small quantity of mercury. In operation, discharging current is rotated about the lamp axis near the top of the discharge lamp by receiving a force due to a magnetic field created by the permanent magnet 14, forming a uniform plasma about the lamp axis. In connection with the base portion of the discharge lamp, the discharging current flows into a fixed point (anode point) of the individual anode electrodes and this anode point shifts every half cycle between anode electrodes 6 and 6' so that a stable and regular rotation of the discharge plasma can be ensured. In this manner, the discharge plasma is distributed uniformly near the top of the discharge lamp and the rotation of the discharge plasma is regular near the base portion. Therefore, the discharge plasma present at an intermediate portion between the top and the base portion is forced to rotate symmetrically with respect to the lamp axis and is uniformed. Thus, a discharge lamp free from flicker can be realized.

In the embodiment of FIG. 4, the permanent magnet 14 was inserted in the recess 13 provided for the top of the outer glass bulb 1. Alternatively, the tubular recess may be dispensed with and the permanent magnet may be disposed at any position near the top of the cuter bulb 1. By driving the discharge plasma to rotate near the top and the base portion of the discharge lamp, it is possible to uniform the discharge plasma symmetrically with respect to the lamp axis throughout the discharge lamp.

Figure 6:
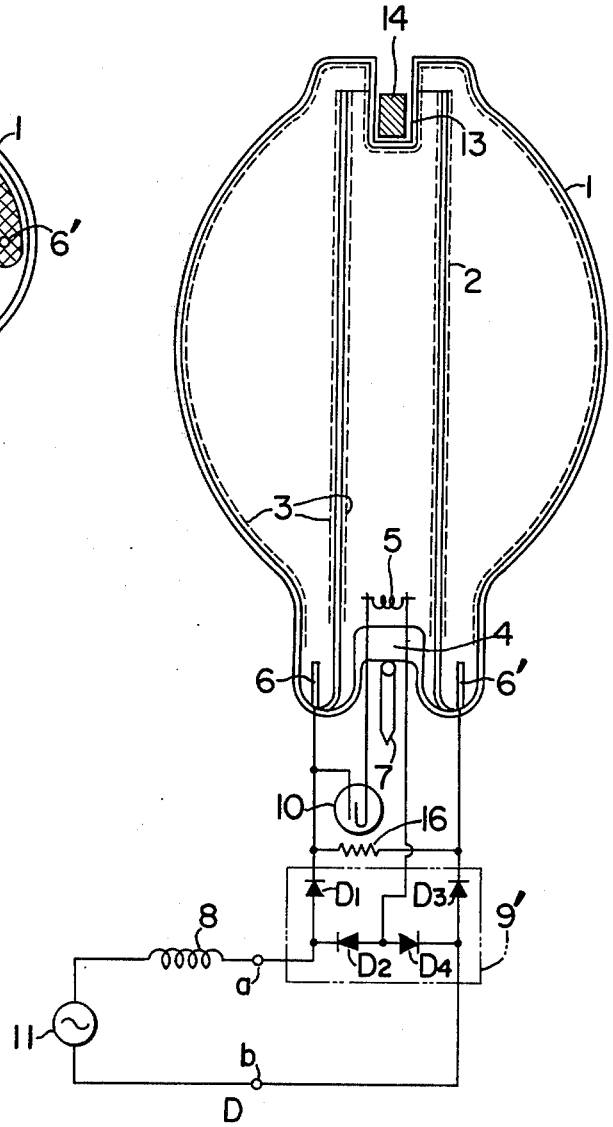
FIGS. 6 to 8 are diagrams similar to FIG. 4 of further embodiments of the invention.

Referring to FIG. 6, a third embodiment of the invention will be described.

Figure 5:
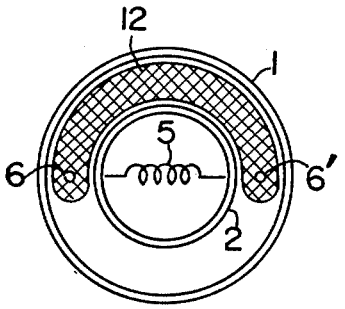
FIG. 5 is a diagramatic representation for explaining the operation of the embodiment shown in FIG. 4.

In the embodiment of FIG. 4, depending on experimental conditions, discharge plasma present at the lower half region of the discharge lamp happens to be offset in one semicircular region illustrated as a hatched section 12 in FIG. 5. Namely, the majority of discharge plasma will not rotate about the lamp axis but will repeat a reciprocation between the anode electrodes 6 and 6' within the semicircular region as shown in FIG. 5. The third embodiment intends to solve this problem. As shown, this embodiment is similar to the embodiment of FIG. 4 except that a resistor 16 is connected between the anodes 6 and 6'. With this construction, when the power supply terminal a bears the positive phase, not only electron beam current flows into the anode electrode 6 but also a small amount of the electron beam current comes into the anode electrode 6'. The electron beam current is shunted to the anode electrodes 6 and 6' in accordance with a ratio which is determined by an impedance value of the resistor 16. When the power supply terminal b bears the positive phase, the shunting ratio of electron beam current is inverted. Thus, electron beam currents coming into the anode electrodes 6 and 6' are averaged to be equal and the individual anode electrodes always receive electron beam currents (except that discharging current is zero).

An example of a discharge lamp constructed according to the embodiment of FIG. 4, in which, in operation, the discharge plasma is offset in such a semicircular region as shown in FIG. 5, was altered into the construction of FIG. 6 and turned on with a discharging current of 0.6 A. For a resistance of 10 kΩ of the resistor 16, an appreciable improvement in uniformity of the discharge plasma was attained. For a reduced resistance of 1 kΩ of the resistor 16, the aforementioned localization of discharge plasma at one side of the lamp disappeared completely and a uniform plasma was observed through the entirety of circumference. For a further reduced resistance of several ohms, an experiment showed that the discharge plasma was uniformed through the whole circumference.

The same effect was attained by using a different suitable impedance element such as a choke coil in place of the resistor 16 connected between the anode electrodes in the embodiment of FIG. 6. It was specifically proved that a choke coil having an impedance less than 1 kΩ was effective to uniform the discharge plasma. It has been found that a lower value of the impedance element such as the resistor 16 contributes to the uniformity of discharge plasma and the impedance value of zero or the short-circuiting between the anodes 6 and 6' as a specified example does not deteriorate the effect of uniforming the discharge plasma.

Figure 7:
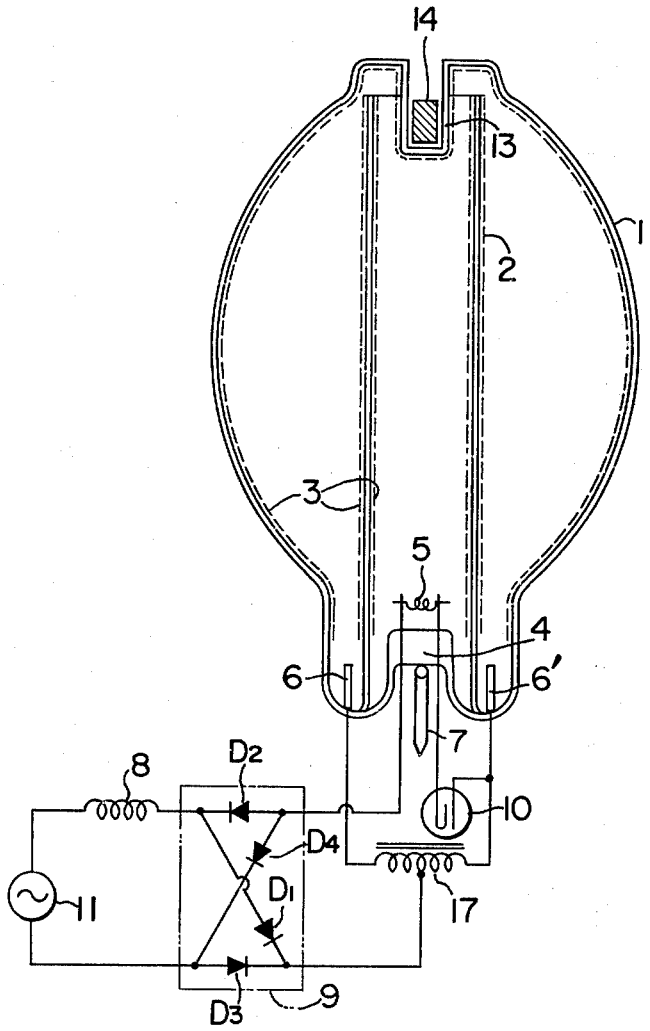

FIG. 7 shows a further embodiment of the invention. Anode electrodes 6 and 6' are connected to each other through a transformer 17, a center tap of which is connected to a positive output terminal of a rectifier circuit 9. When electron beam current first flows into the anode electrode 6, a voltage is induced in the transformer 17, thereby raising voltage of the anode electrode 6' with respect to that of the anode electrode 6. Accordingly, the electron beam current flow is switched to the anode electrode 6'. Concurrently with the electron beam current flow into the anode electrode 6', a voltage is induced in the transformer 17, raising now voltage of the anode electrode 6 with respect to that of the anode electrode 6', and the electron beam current is again switched to the anode eletrode 6. In this manner, the anode electrodes 6 and 6' always receive the same amount of average electron beam currents under the stationary condition. As having been discribed, the magnetic field generated by the permanent magnet 14 creates a uniform plasma rotating about the lamp axis near the top of the discharge lamp. Further, in this embodiment, it is possible to pass the electron beam currents uniformly into the two anode electrodes arranged about the axis of the discharge lamp at the base portion thereof with an angular spacing of 180°. As a result, a discharge plasma present at an intermediate between the top and the base portion can be uniformed about the lamp axis through the whole circumference.

Figure 8:
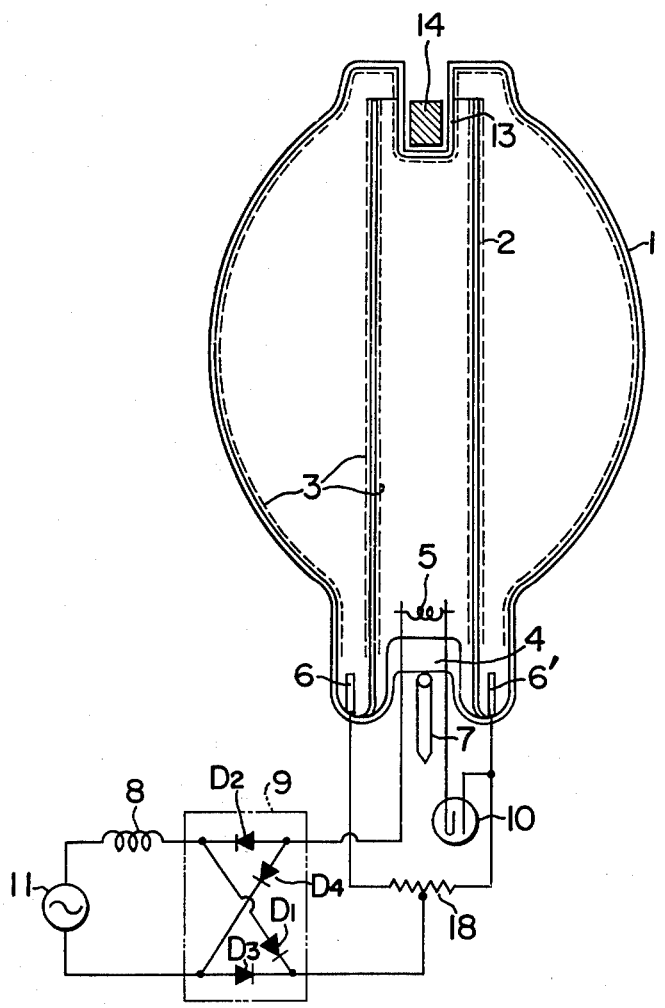

The transformer 17 of FIG. 7 may be replaced by a resistor 18 as shown in FIG. 8 or the resistance of the resistor 18 may be made zero to electrically short-circuit the anode electrodes 6 and 6'. Further, the resistor 18 may be replaced by two choke coils connected in series between the anode electrodes 6 and 6', wherein a junction between the two choke coils may be connected to the positive output terminal of the rectifier circuit 9.

In the latter case, too, the plasma can be uniformed with slight reduction in the effect.

As described above, according to the invention, in the low pressure metal vapor discharge lamp with the discharge envelope of double tube structure type having the outer glass bulb and the inner glass tube, the permanent magnet is disposed at the top of the lamp for applying to the discharging current a force which causes it to rotate about the axis of the lamp to thereby uniform the plasma, and a plurality of anode electrodes are disposed near the base portion of the lamp in spaced relationship with each other so that the electron beam current may be passed into the individual anode electrodes, thereby distributing the plasma present at the intermediate of lamp uniformly about the axis of the lamp. The foregoing embodiments have been described as using two anode electrodes but, obviously, the invention may be applicable to the provision of more than three anode electrodes which are arranged symmetrically with respect to the lamp axis with equal angular spacings.

What is claimed is:

1. A low pressure metal vapor discharge lamp comprising:

a discharge envelope including an outer bulb made of light-transmissive material and an inner tube disposed within said outer bulb, said inner tube having one open end and the other closed end;

an inert gas and metal filled in said envelope;

a cathode disposed interiorly of said inner tube;

an anode disposed exteriorly of said inner tube and interiorly of said outer bulb; and magnetic field applying means disposed near the open end of said inner tube for applying a magnetic field near the open end.

2. A low pressure metal vapor discharge lamp according to claim 1, wherein said magnetic field applying means includes a permanent magnet disposed near the open end of said inner tube.

3. A low pressure metal vapor discharge lamp according to claim 2, wherein said outer bulb emerges into a tubular recess which confronts the open end of said inner tube, and said permanent magnet is inserted in said recess.

4. A low pressure metal vapor discharge lamp according to claim 1, wherein said anode is disposed near the closed end of said inner tube.

5. A low pressure metal vapor discharge lamp according to claim 1, wherein said cathode is disposed near the closed end of said inner tube.

6. A low pressure metal vapor discharge lamp according to claim 1, wherein said inner tube is disposed concentrically with said outer bulb.

7. A low pressure metal vapor discharge lamp according to claim 1, wherein said inner tube is made of light-transmissive material.

8. A low pressure metal vapor discharge lamp according to claim 7, wherein said outer bulb has its inner surface coated with a phosphor film.

9. A low pressure metal vapor discharge lamp according to claim 8, wherein said inner tube has its inner surface and outer surface coated with a phosphor film.

10. A low pressure metal vapor discharge lamp according to claim 1, wherein said outer bulb is made of light-transmissive glass.

11. A low pressure metal vapor discharge lamp according to claim 1, wherein said inner bulb is made of light-transmissive glass.

12. A low pressure metal vapor discharge lamp comprising:

a discharge envelope including an outer bulb made of light-transmissive material and an inner tube disposed within said outer bulb, said inner tube having one open end and the other closed end;

an inert gas and metal filled in said envelope;

a cathode disposed interiorly of said inner tube;

a plurality of anodes disposed exteriorly of said inner tube and interiorly of said outer bulb; and magnetic field applying means disposed near the open end of said inner tube for applying a magnetic field near the open end.

13. A low pressure metal vapor discharge lamp according to claim 12, wherein said magnetic field applying means includes a permanent magnet disposed near the open end of said inner tube.

14. A low pressure metal vapor discharge lamp according to claim 12, wherein the plurality of anodes are disposed near the closed end of said inner tube.

15. A low pressure metal vapor discharge lamp according to claim 12, wherein said cathode is disposed near the closed end of said inner tube.

16. A low pressure metal vapor discharge lamp according to claim 12, wherein said inner tube is disposed concentrically with said outer bulb.

17. A low pressure metal vapor discharge lamp according to claim 12, wherein said inner tube is made of light-transmissive material.

18. A low pressure metal vapor discharge lamp according to claim 17, wherein said outer bulb has its inner surface coated with a phosphor film.

19. A low pressure metal vapor discharge lamp according to claim 18, wherein said inner tube has its inner surface and outer surface coated with a phosphor film.

20. A low pressure metal vapor discharge lamp according to claim 12, wherein said outer bulb is made of light-transmissive glass.

21. A low pressure metal vapor discharge lamp according to claim 12, wherein said inner bulb is made of light-transmissive glass.

22. A low pressure metal vapor discharge lamp according to claim 12, further comprising at least one resistor coupled between the plurality of anodes.

23. A low pressure metal vapor discharge lamp according to claim 12, further comprising at least one transformer coupled between the plurality of anodes.

24. A low pressure mercury vapor discharge lamp comprising:

a discharge envelope including an outer glass bulb and an inner glass tube disposed concentrically therewith, said inner glass tube having one open end and the other closed end;

an inert gas and a small quantity of mercury filled in said envelope;

a cathode disposed interiorly of said inner glass tube and near the closed end of said inner glass tube;

a plurality of anodes disposed, near the closed end of said inner glass tube, exteriorly of said inner glass tube and interiorly of said outer glass bulb; and a permanent magnet disposed near the open end of said inner glass tube for applying a magnetic field of a fixed intensity near the open end.

* * * * *